US007031643B2

(12) United States Patent
Tamura

(10) Patent No.: US 7,031,643 B2
(45) **Date of Patent: *Apr. 18, 2006**

(54) DEVELOPING DEVICE

(75) Inventor: Masashige Tamura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/079,421

(22) Filed: Mar. 15, 2005

(65) Prior Publication Data

US 2005/0158081 A1 Jul. 21, 2005

Related U.S. Application Data

(62) Division of application No. 10/440,192, filed on May 19, 2003, now Pat. No. 6,934,491.

(30) Foreign Application Priority Data

May 22, 2002 (JP) ..... 2002-147731

(51) Int. Cl.
*G03G 15/01* (2006.01)

(52) U.S. Cl. ..... 399/227

(58) Field of Classification Search ..... 399/107, 399/111, 112, 119, 120, 227
See application file for complete search history.

(56) References Cited

U.S. PATENT DOCUMENTS

| | | | | |
|---|---|---|---|---|
| 5,508,794 | A | 4/1996 | Ikesue et al. | 399/120 |
| 5,752,141 | A | 5/1998 | Nishimura et al. | 399/227 |
| 2003/0219283 | A1* | 11/2003 | Tamura | 399/227 |

FOREIGN PATENT DOCUMENTS

| | | |
|---|---|---|
| JP | 6-308829 | 4/1994 |
| JP | 9-218575 | 8/1997 |
| JP | 10-142888 | 5/1998 |
| JP | 10-161420 | 6/1998 |
| JP | 11-249418 | 9/1999 |
| JP | 2002-258611 | 9/2002 |

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

A developing device including: plural developing units each for developing an electrostatic image formed on an image bearing member with developer that contains toner and carriers in a developing portion; a rotary member for mounting the plurality of developing units thereon and rotating along a path that includes the developing portion; and a containing pipe provided in the rotary member to contain excess developer discharged from the developing units in association with a replenishment of developer, in which the containing pipe is substantially non-rotatably provided, and the developer in the containing pipe is fed utilizing the rotation of the rotary member.

4 Claims, 6 Drawing Sheets

FIG. 3B
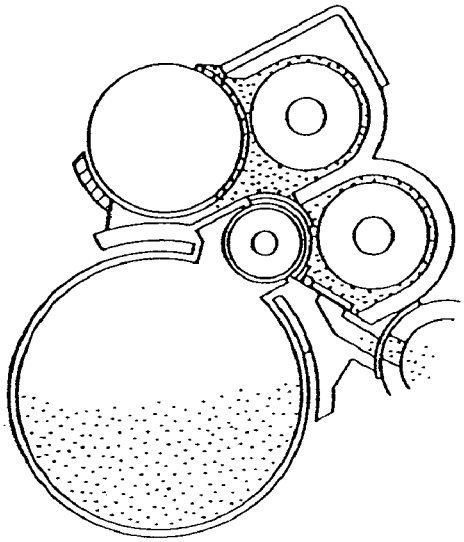
FIG. 3A
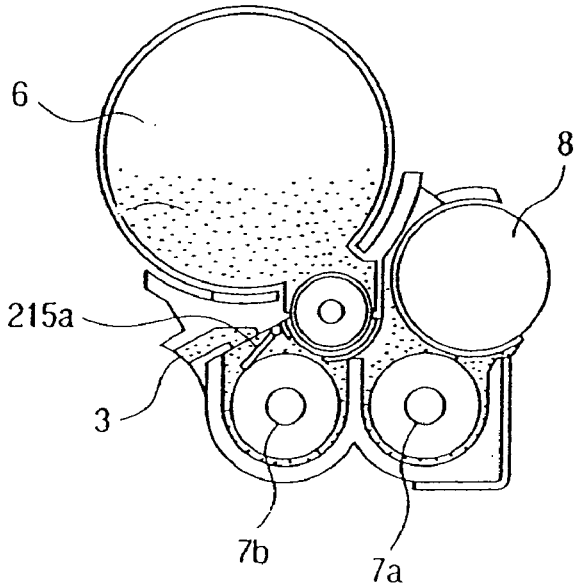
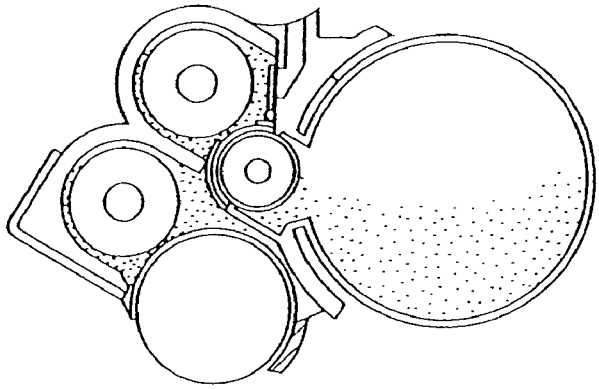
FIG. 3C

DEVELOPING DEVICE

CROSS-REFERENCE TO RELATED APPLICATION

This application is a divisional of application Ser. No. 10/440,192, filed May 19, 2003 now U.S. Pat. No. 6,934,491.

BACKGROUND OF THE INVENTION

1. Field of the Invention

The present invention relates to a developing device for use in a copying machine, printer, facsimile machine, or the like that employs electrophotographic process or electrostatic recording.

2. Related Background Art

According to the method commonly used in multicolor image formation, toner images in different colors from one another are sequentially formed on a photosensitive member and the toner images in different colors are overlapped on a transfer medium such as a sheet of paper sequentially or collectively. For such multicolor image forming apparatus, a so-called rotary developing process has been proposed and put into practical use. In this process, developing units for black, yellow, magenta, and cyan colors are mounted to a rotary developing member and the rotary developing member is rotated to sequentially deliver necessary developing units to a development position facing a photosensitive member that is an image bearing member for a development operation.

On the other hand, dual-component development in which non-magnetic toner and a magnetic carrier are mixed for use as developer is widely employed among conventional electrophotographic process image forming apparatus, especially multicolor image forming apparatus for forming chromatic color images. Compared to other development methods that have been proposed, dual-component development has advantages including stable image quality and apparatus durability. However, long use means that developer degradation, carrier degradation in particular, is unavoidable. Replacing old developer with new one is therefore necessary for multicolor image forming apparatus that is long in use and it results in an increase in service cost or running cost.

Several solutions have been proposed for this problem. One of these solutions is a developing unit that is loaded with a replaceable developer replenishing cartridge to replenish developer containing toner and a carrier and to collect the developer (see JP 06-308829 A).

However, this developing unit makes image forming apparatus large in size and its control mechanism complicated because it employs a structure in which plural screws are used to collect developer that has overflown the developing unit and send the developer to the developer replenishing cartridge. With the thus structured developing unit and developer replenishing cartridge mounted, a rotary developing member itself is increased in diameter and the multicolor image forming apparatus becomes large in size. Furthermore, the developer feeding path is complicated enough to cause leakage of the developer when the rotary developing member is rotated.

Then, a developer discharging method has been put into practical use particularly for the rotary developing process. This method utilizes changes in direction the gravity works which accompany the rotational motion of the rotary developing member to replenish a developing unit with dual-component developer and to discharge the dual-component developer from the developing unit (JP 09-218575 A).

On the other hand, JP 10-142888 A discloses another structure: at a development position where a developing unit faces a photosensitive drum, developer discharged from a developing container is temporarily pooled in a reservoir, is fed to a cylindrical shaft at the center of a rotary developing member utilizing a change in direction the gravity works due to rotation of the rotary developing member, and ultimately is collected by a developer feeding member in the cylindrical shaft to be sent into a developer collecting container that is provided at a shaft end of the cylindrical shaft. Similar to the multicolor image forming apparatus proposed in JP 09-218575 A, this structure discharges developer by utilizing the motion unique to any rotary developing member. Therefore, this structure prevents carriers from losing their charging ability while avoiding an increase in size of the multicolor image forming apparatus. In addition, even when monochromatic images are formed in succession, excess developer in the developing unit is discharged and sent into the reservoir outside of the developing unit at the development position without stopping the development operation. Accordingly, the image productivity is not lowered and the developer amount in the developing unit is kept within an acceptable range.

JP 11-249418 A presents an example in which a feeding unit for feeding excess developer to a cylindrical shaft at the center of a rotary developing member is structured to be collectable utilizing a change in gravitational direction due to rotation of the rotary developing member. In this proposal, a spiral auger is arranged in the interior of the cylindrical shaft that is provided so as to rotate with the rotary developing member as one, and the spiral auger is rotated and driven by a drive motor to feed excess developer in the cylindrical shaft.

These examples of the conventional art have the following problems.

To meet the demand made along the recent growth of full-color copying machine/printer market for various functions, a lot of multicolor image forming apparatus reduced in size and cost while aiming at high image productivity have been commercialized and they are expected to rank among the mainstream of the future market.

In this context, it is apparent that techniques related to a simply-structured developing unit which prevents carriers from losing their charging ability without increasing the size or cost of multi-color image forming apparatus, which suppresses an increase in service cost or running cost, and which replenishes developer containing toner and a carrier as well as collects excess dual-component developer, will continue to hold an important position.

The method of discharging developer to the outside of a rotary developing member after excess developer is collected in the center of the rotary developing member collectively as shown in the examples of the conventional art (JP 10-142888 A and JP 11-249418 A), allows degraded excess developer in a developing unit to gather in one place and does not need to process degraded excess developer in individual developing units separately. This method is therefore desired to improve through technical development in the future.

However, the multicolor image forming apparatus of JP 10-142888 A and the multicolor image forming apparatus of JP 11-249418 A both employ the structure in which an external input is used to rotate and drive screws arranged in a cylindrical shaft that is located in the vicinity of the central axis inside the rotary developing member. This complicates the drive system of the image forming apparatus main body and the cost is raised because of drive trains.

Specifically, laborious installment of the complicated drive system and an increase in number of parts raise cost. The drive system is complicated because it is necessary to input a driving force from a development drive motor into the feeding screws by connecting the drive trains from the drive system in order to rotate the feeding screws during a continuous image-forming operation, which is most appropriate considering that excess developer is discharged in the cylindrical shaft portion during development.

Another method conceivable is to input a driving force to the feeding screws by splitting a drive system for rotating and driving a rotary developing member. A rotary motor for the rotary developing member rotates and drives at a high speed the rotary developing member, which is very large in inertial mass. Therefore, in most cases, a large-sized stepping motor is used as the rotary motor and the driving force is transmitted directly to a large-diameter gear of the rotary developing member with the reduction gear ratio set extremely low. Driving the feeding screws by the driving force from this drive system often presents design difficulties. Accordingly, complication of image forming apparatus and an increase in cost is unavoidable in implementation of this method.

Then, the method disclosed in an embodiment of JP 11-249418 A, which is above-described as an example of the conventional art and in which the rotational motion of a rotary developing member is utilized to discharge from its central cylindrical shaft degraded excess developer to the outside of the rotary developing member, has attracted attention as a simple, effective technique which does not cause enlargement of multicolor image forming apparatus or an increase in cost. However, the multicolor image forming apparatus disclosed in JP 10-142888 A and the multicolor image forming apparatus disclosed in JP 11-249418 A both need to place an excess developer collecting inlet of the cylindrical shaft on the cylinder surface in order to collect excess developer. If a helical groove is formed on the inner wall of the cylindrical shaft and is rotated together with the rotary developing member, the collecting inlet too is rotated to make collecting excess developer impossible.

Rotating a cylindrical shaft of a rotary developing member is also necessary in the method of feeding excess developer through the rotational motion of a rotary developing member by fixing an end of a feeding screw to a drive unit that is provided on a side plate of the main body. In addition, the ability of feeding excess developer is insufficient. These feeding methods that utilize the rotational motion of a rotary developing member are therefore cannot be employed in real products.

SUMMARY OF THE INVENTION

An object of the present invention is to provide a developing device in which excess developer in a containing pipe can be fed with a simple structure.

Other objects of the present invention will become clear through the following detailed description referring to the accompanying drawings.

BRIEF DESCRIPTION OF THE DRAWINGS

In the accompanying drawings:

FIGS. 3A, 3B, and 3C are explanatory diagrams illustrating an excess developer discharging operation of color developing units according to an embodiment of the present invention;

DESCRIPTION OF THE PREFERRED EMBODIMENTS

Figure 1:
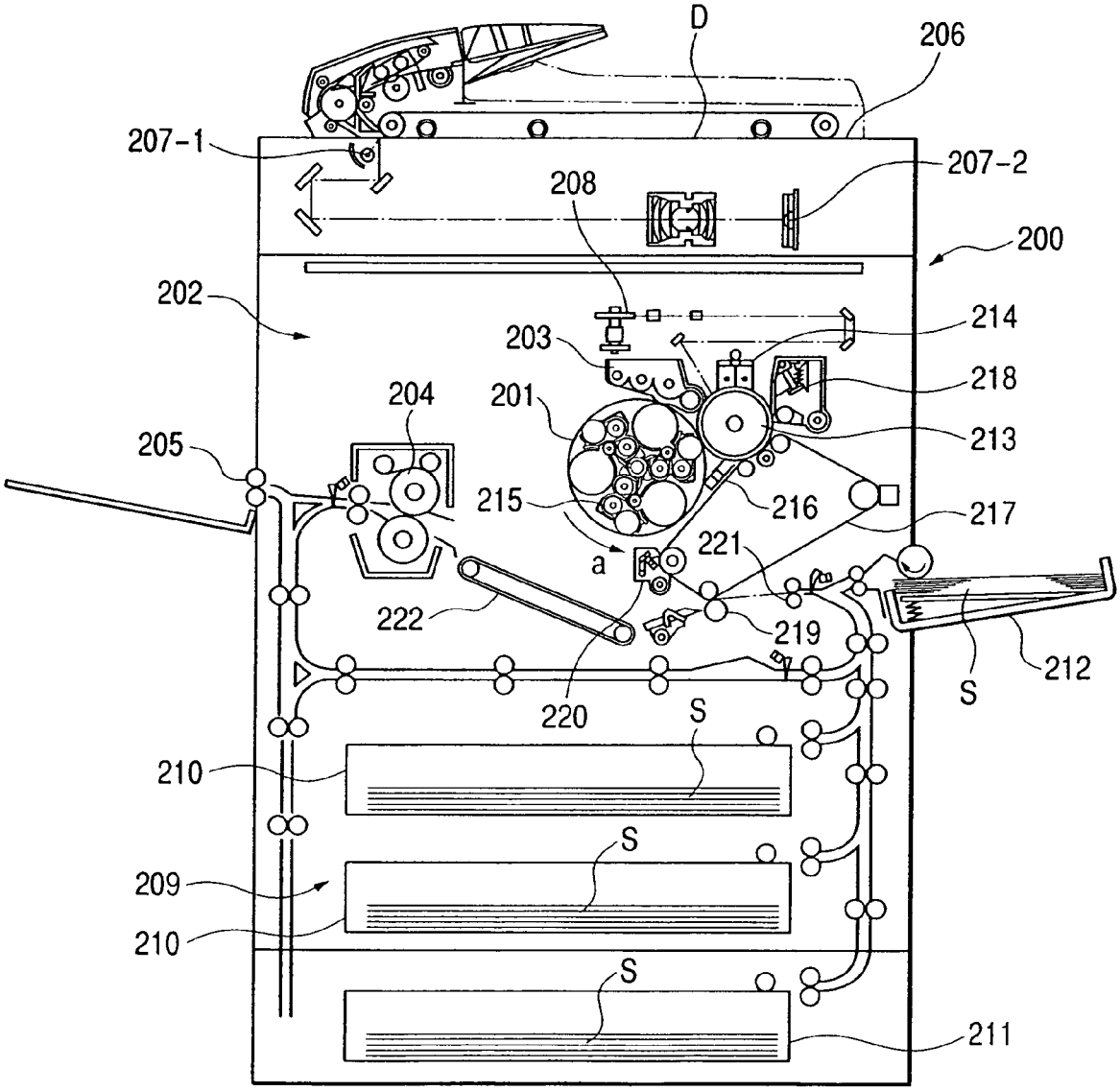
FIG. 1 is a frontal sectional view showing an example of multicolor image forming apparatus equipped with a rotary developing member supporting frame body according to an embodiment of the present invention.

FIG. 1 shows an example of multicolor image forming apparatus (color copying machine) equipped with a rotary developing member to which the present invention is applied.

An apparatus main body 200 shown in FIG. 1 is multicolor image forming apparatus having a rotary developing member 201 that is a rotary developing member according to this embodiment.

The apparatus main body 200 has an original table 206, a light source 207-1, a lens system 208, a sheet feeding unit 209, an image forming section 202, and others. The sheet feeding unit 209 has cassettes 210 and 211 and a manual feed cassette 212 which house transfer materials and which are detachably attachable to the apparatus main body 200. The cassettes 210 and 211 and the manual feed cassette 212 supply transfer materials. The image forming section 202 has arranged therein a black developing unit 203 that is a single structure; a cylindrical photosensitive drum 213; a primary charger 214; the rotary developing member 201 housing color developing units 215 which are for other three colors and which are each integrated with a toner cartridge 6; a post charger 216 for adjusting the image quality after development; an endless, ring-like transfer belt 217 for transferring a multicolor image onto a transfer material after transfer and image formation by overlapping toner images in four colors; a drum cleaner 218 for cleaning residual toner on the photosensitive drum; a secondary transfer roller 219 for transferring a toner image from the transfer belt onto a transfer material; a belt cleaner 220 for cleaning residual toner on the transfer belt; and others.

Note that, in this embodiment, the image forming section 202 has the black developing unit 203 and the rotary developing member 201 as shown in FIG. 1. The rotary developing member 201 has color developing units for three colors: a yellow developing unit 215Y, a magenta developing unit 215M, and a cyan developing unit 215C. The number of developing units mounted to the rotary is not limited to three in accordance with the spirit of the present invention.

There is a registration roller 221 upstream of the image forming section 202. The registration roller 221 enhances the accuracy in posture and position of a transfer material and sends transfer materials forward at a pace timed to formation of toner images on the transfer belt. Placed downstream of the image forming section 202 are: a transfer feeding device 222 for feeding a transfer material S on which a toner image is transferred; a fixing device 204 for fixing the unfixed image on the transfer material S; a delivery roller 205 for delivering the transfer materials S with the fixed image to the outside of the multicolor image forming apparatus.

Now, a description is provided for an operation of this multicolor image forming apparatus.

In response to a sheet feed signal outputted from a control device (not shown) provided on the side of the apparatus main body 200, a transfer material S is supplied from the cassette 210 or 211, or the manual feed cassette 212. On the other hand, light from the light source 207-1 is projected onto and reflected at an original D put on the original table 206. The reflected light is read by a CCD unit 207-2 once, then converted into an electric signal and then substituted with laser light from a laser scanner unit 208 to irradiate the photosensitive drum 213. The photosensitive drum 213 is charged in advance by the primary charger 214 and forms an electrostatic latent image when irradiated with light. Next, a black toner image is formed on the photosensitive drum 213 by the black developing unit 203.

The electric potential of the toner image formed on the photosensitive drum is adjusted by the post charger 216 and the image is then transferred onto the transfer belt 217 when the transfer position is reached. If the toner image transferred is of color mode, the transfer belt 217 makes one more turn for formation and transfer of the next toner image. Meanwhile, the rotary developing member 201 rotates in the direction indicated by the arrow "a" to position the developing unit of a designated color opposite to the photosensitive drum 213 in preparation for formation of the first toner image and of development of the next electrostatic latent image. In this way, in the full-color mode, formation of an electrostatic latent image, development, and transfer are repeated until transfer of a given number of toner images is completed.

If the transfer material S fed from the sheet feeding unit 209 is skewed, the registration roller 221 corrects the skew feed of the transfer material S and the transfer material S is then sent to the image forming section 202 with a correct timing. The secondary transfer roller 219 transfers a toner image and the transfer material S separated therefrom is fed by the feeding device 222 to the fixing device 204 so that the unfixed transfer image is permanently fixed onto the transfer material S by heat and pressure of the fixing device 204. The transfer material S with the fixed image is delivered from the apparatus main body 200 by the delivery roller 205.

In this way, the transfer material S fed from the sheet feeding unit 209 has an image formed thereon and then is delivered.

Figure 2:
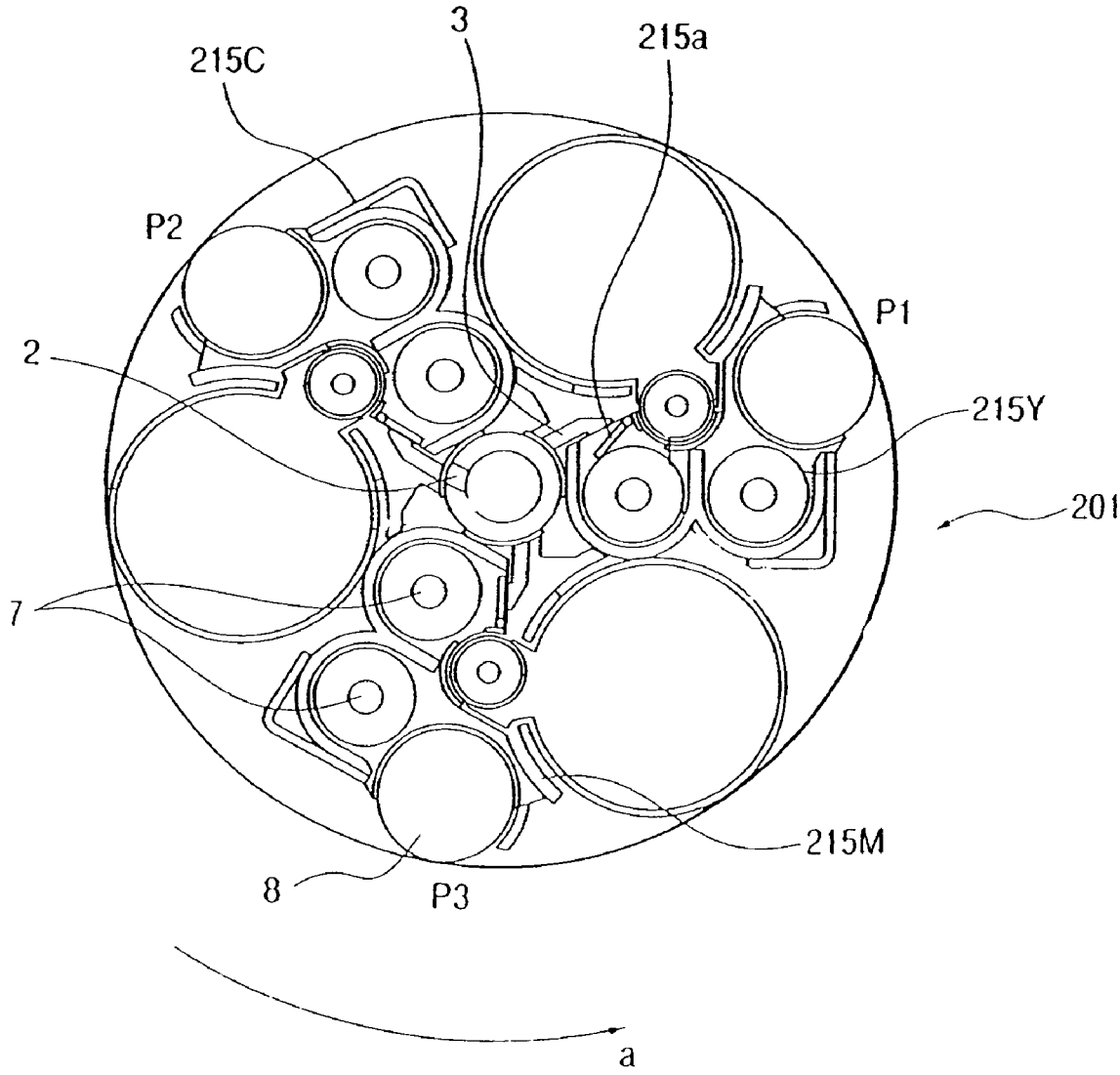
FIG. 2 is a frontal view showing a structure of a major part to illustrate a rotary developing member according to an embodiment of the present invention.

Next, a detailed description will be given with reference to FIG. 2 on the structure of the color developing units mounted in the rotary developing member as a rotary member. As mentioned above, the rotary developing member 201 has the yellow developing unit 215Y, the magenta developing unit 215M, and the cyan developing unit 215C, and can be rotated freely by a motor which is not shown in the drawing. In the initial state, the rotary developing member 201 rests at a rotation position which is 60° short of a development position P1 at which the yellow developing unit 215Y comes close to the photosensitive drum 213. As described above, this is for putting a development sleeve provided in each color developing unit on stand-by at the farthest phase position from a photosensitive member, so that the strong magnetic force of the development sleeve as a developer bearing member does not affect the photosensitive member (the rotary developing member 201 shown in the drawing is in the image formation process).

When a full-color toner image is to be formed on the photosensitive drum 213 which is an image bearing member, development in the black developing unit 203 is followed by rotation of the yellow developing unit by 60° to move the yellow developing unit to the development position P1 where it comes near the photosensitive drum 213 for development. Next, a toner image in another color is formed by rotating the rotary developing member 201 by 120° to position the magenta developing unit 215M at the development position P1 for development in a similar manner. Then a toner image in cyan color is similarly formed. After the development operation is finished for each color, the rotary developing member 201 is rotated by 60° to return to the home position again where it is put on stand-by for the next job.

When an image to be formed is a black and white image, a toner image is formed on the photosensitive drum 213 by the black developing unit 203, which contains black toner. The toner image is primarily transferred onto the transfer belt 217 and immediately undergoes secondary transfer on the transfer material S. The transfer material S peeled from the transfer belt 217 is fed by the feeding device 222 to the fixing device 204, where the transferred image is pressurized/heated to form a permanent image. Formation of a monochromatic image by this method is about four times higher in image productivity than full-color image formation.

A detailed description is given with reference to FIGS. 3A, 3B, 3C, 4, and 5 for the excess developer discharging mechanism, which is a feature of this embodiment, taking the yellow developing unit 215Y as an example.

Figure 4:
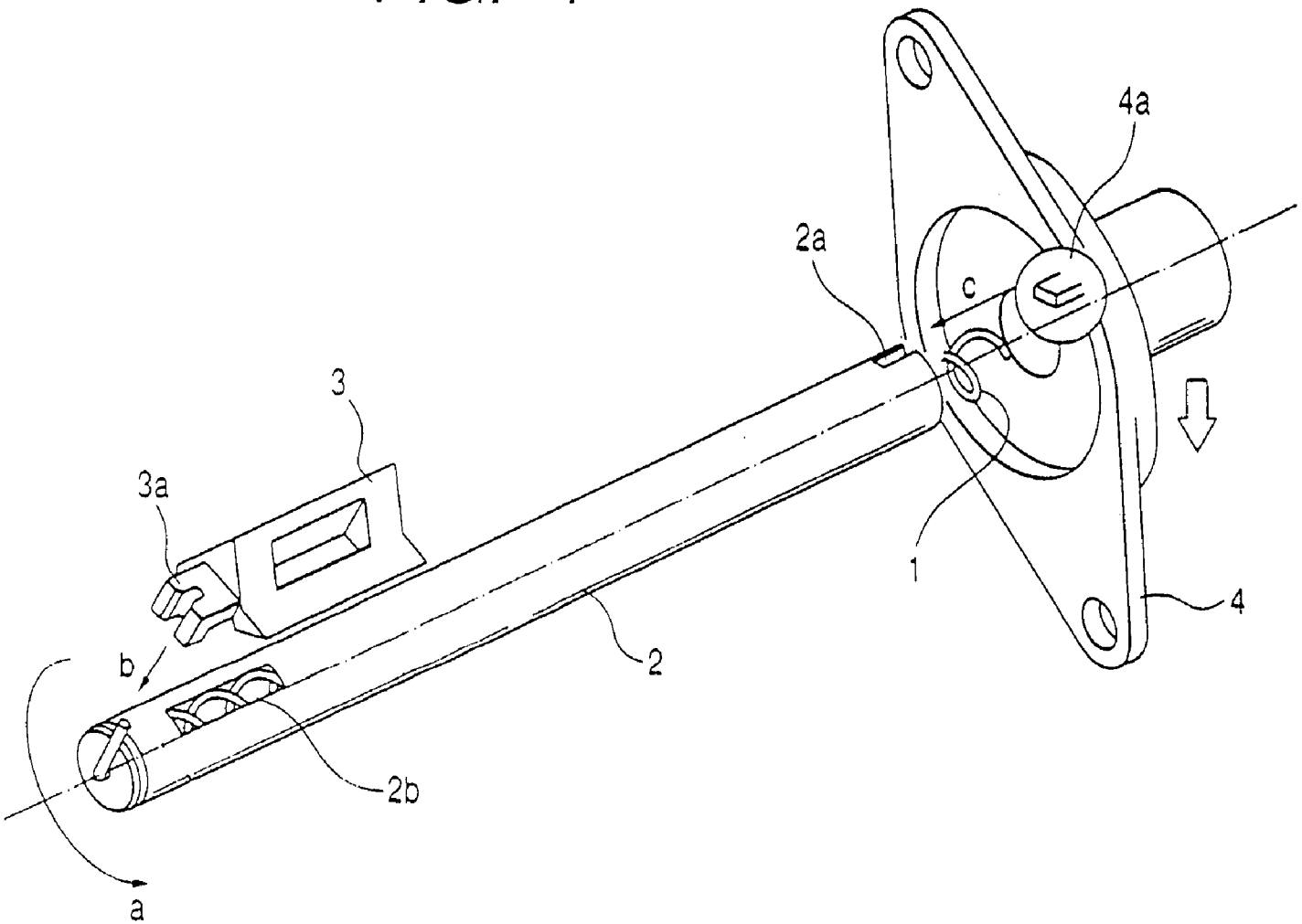
FIG. 4 is a perspective view showing the structure of an essential part to illustrate an excess developer feeding mechanism in a rotary developing member according to an embodiment of the present invention.
Figure 5:
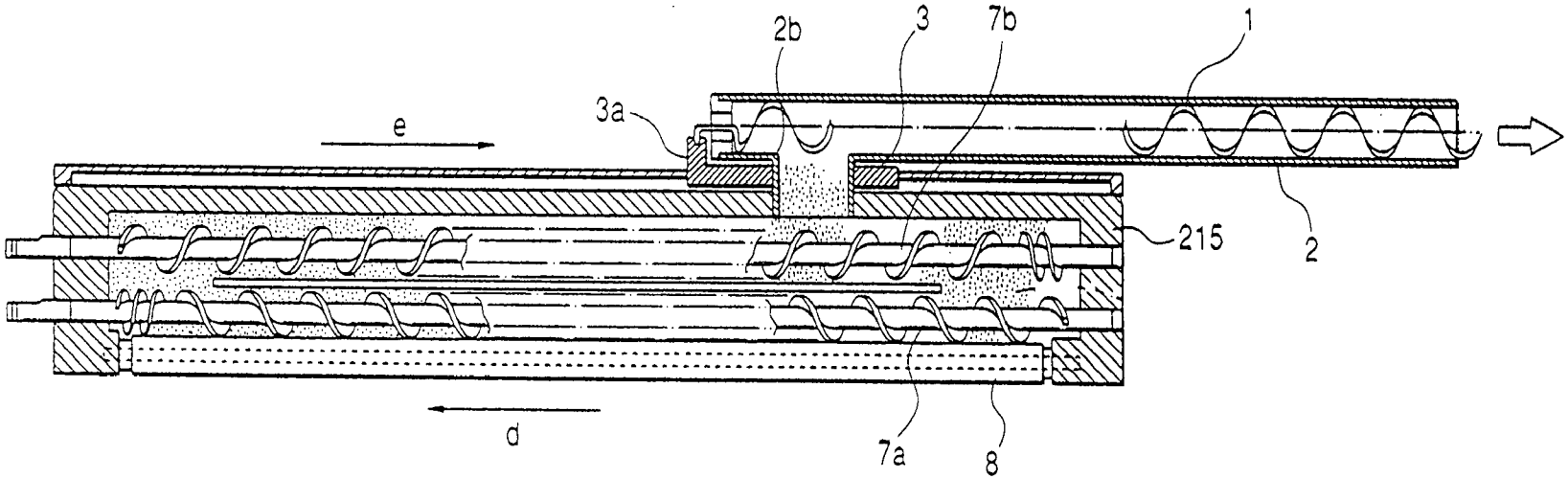
FIG. 5 is a top view illustrating an excess developer feeding mechanism in a rotary developing member according to an embodiment of the present invention.
Figure 6:
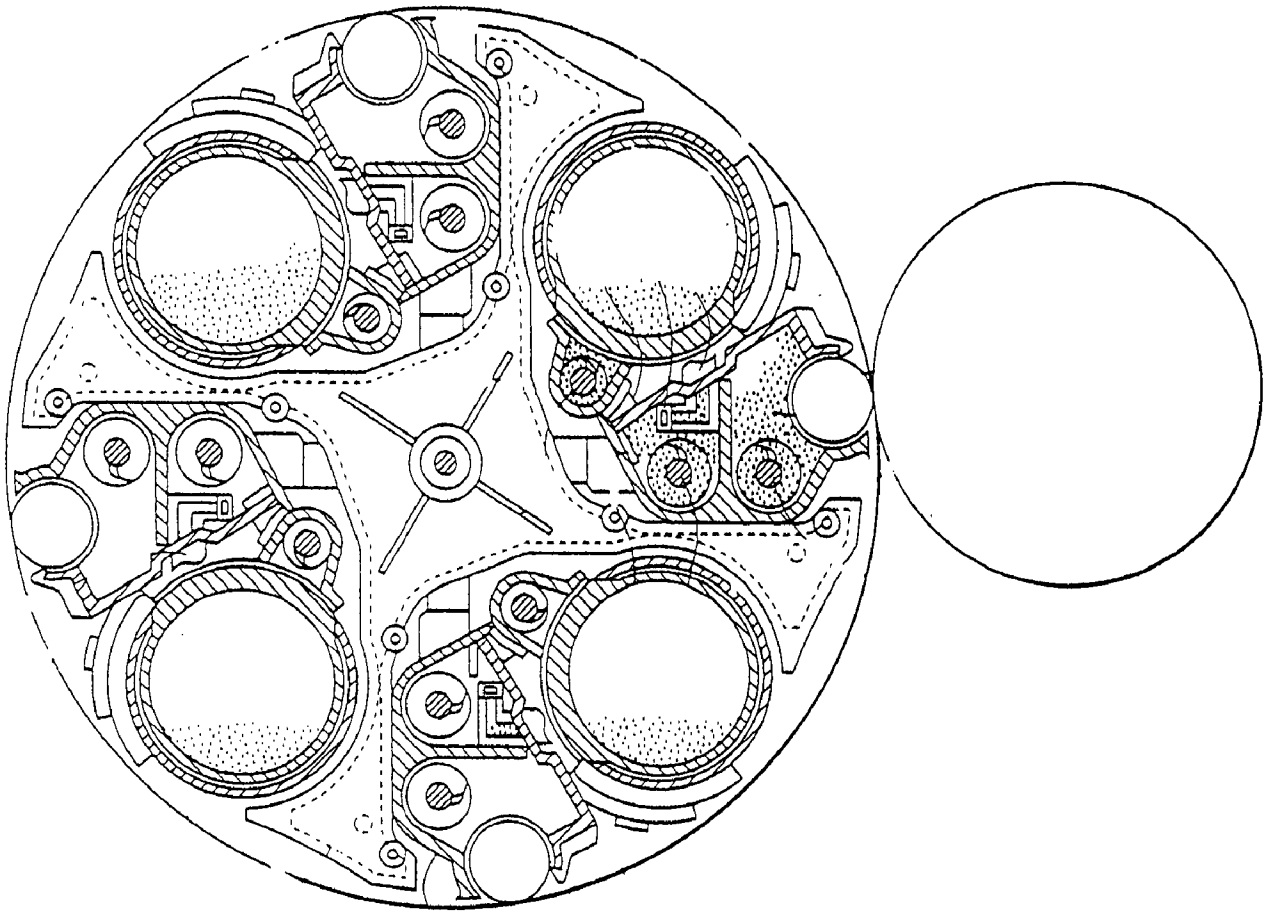
FIG. 6 PRIOR ART
FIG. 6 is a diagram showing an essential part to illustrate a conventional rotary developing member.

FIGS. 3A, 3B, and 3C are explanatory diagrams illustrating an operation of discharging excess developer in this embodiment. FIG. 4 is a perspective view showing a structure of an essential part to illustrate the excess developer discharging operation inside the rotary developing member 201. FIG. 5 is a top view thereof. In FIGS. 4 and 5, reference numeral 1 denotes a coil-shaped feeding member which serves as a feeding member for feeding excess dual-component developer that has been discharged from the developing units 215 to the outside of the rotary developing member. Denoted by 2 is a feeding pipe that is a feeding frame member hollowed to incorporate the feeding means therein. In this embodiment, the coil-shaped feeding member 1 and the feeding pipe 2 which serves as a containing pipe constitute a feeding unit. Denoted by 3 is an outlet as a connection pipe which is connected to an outlet 215*a* of each of the developing units 215 to lead excess dual-component developer to the feeding unit. Reference numeral 4 represents a pipe outlet holding-down member which is connected to an end of the feeding pipe 2 on the outer side of the rotary developing member 201. Note that a coil-shaped member is chosen in this embodiment for the feeding means 1 with the intention of lowering the cost further. However, it is needless to mention that the spirit of the present invention allows the feeding means to have other structures that can readily be thought of, such as a screw.

One end of the coil-shaped feeding member 1 is bent at a substantially right angle with the axial direction of the coil and is engaged with and attached to an engagement portion 3*a* of the outlet 3 (an arrow "b" in FIG. 4). This allows the coil-shaped feeding member 1 to rotate in conjunction with the outlet 3 which rotates along with the rotary developing member 201 when the rotary developing member 201 rotates in the direction indicated by the arrow "a" in FIG. 4.

On the other hand, the feeding pipe 2 has an engagement portion 2*a* which is engaged with a pipe outlet holding-down member 4 at its end that is on the outer side of the rotary developing member 201. The engagement portion 2*a* is engaged with and attached to a projection portion 4*a* which is provided in the pipe outlet holding-down member 4 (an arrow "c" in FIG. 4). This prevents the feeding pipe 2 from rotating in conjunction with the coil-shaped feeding member 1 and the outlet 3 which rotate along with the rotary developing member 201 when the rotary developing member 201 rotates in the direction indicated by the arrow "a" in FIG. 4. As a result, the feeding pipe 2 always keeps its posture. In this way, a window portion 2*b* provided in the feeding pipe 2 to serve as an inlet for receiving excess developer is kept opened upward. This allows the discharging mechanism to maintain stable discharge operation and provides excellent image stability. In addition, the feeding pipe needs only one window portion 2*b* to make it possible to receive excess developer from the three developing units with a simple structure. These are given as features of the present invention.

Each of the developing units 215 contains dual-component developer composed of non-magnetic toner and magnetic carriers. The toner density in the developer in the initial state is about 8% by weight. This value should be adjusted properly in accordance with the toner charge amount, the grain size of the carriers, the structure of the multicolor image forming apparatus, and the like, and is not to limit the initial toner density.

When one of the developing units 215 conducts the development operation at the development position P1, the developing unit is replenished with dual-component developer from the developer cartridge 6 to compensate the developing unit for toner consumed by image formation. At this point, the developing unit also receives carriers of about 10% by weight for replenishment. This means that the developing units 215 are replenished with carriers each time image formation is finished. When a high density image is to be formed in particular, a large amount of carriers, about several tens mg, are supplied to increase the developer amount in the developing units 215 and raise the developer surface level. If the developer surface level rises higher than a second developer circulator screw 7*b*, the second developer circulator screw 7*b* cannot stir the developer sufficiently. Therefore, the toner that has just been supplied for replenishment is fed without being sufficiently charged to a first developer circulator screw 7*a* to be used in the development operation. As a result, a white portion of an image is fogged with toner. If the developer amount is increased further, the developer overflows the developing units 215 smearing the interior of the multicolor image forming apparatus.

The developer outlet 215*a* is substantially level with the upper edge of the second developer circulator screw 7*b* as shown in FIG. 3A. When the developer surface level rises higher than the second developer circulator screw 7*b*, excess developer overflows and is discharged from the developer outlet 215*a* to keep the developer surface level at the level of the second developer circulator screw 7*b*. The above-described toner fog of a white portion in an image and overflow of developer from the developing units 215 are thus avoided.

A development region opposed to the photosensitive drum 213 is opened in each of the developing units 215. A developing sleeve 8 is placed rotatably while being partially exposed in the opening. The developing sleeve 8 contains a fixed magnet that is magnetic field generating means, and is formed of a non-magnetic material. During the development operation, the developing sleeve 8 is rotated to keep the dual-component developer in the developing units 215 in layers and bears and feeds the developer to the development region. With the dual-component developer supplied to the development region that faces the photosensitive drum 213, an electrostatic latent image on the photosensitive drum 213 is developed. The dual-component developer after the electrostatic latent image is formed is fed as the developing sleeve 8 is rotated and is collected to the developing units 215. The dual-component developer in the developing units 215 is circulated by the first developer circulator screw 7*a* (on the near side of the developing sleeve 8) and the second developer circulator screw 7*b* (on the far side of the developing sleeve 8), so that the developer is stirred and mixed in the developing units 215. The first developer circulator screw 7*a* makes the developer circulate from right to left in FIG. 5 (in the direction indicated by the arrow "d" in FIG. 5). The second developer circulator screw 7*b* makes the developer circulate from left to right in FIG. 5 (in the direction indicated by the arrow "e" in FIG. 5). Each of the developing units 215 has a developer replenishing port (not shown) at an end of its upper wall which is near the second developer circulator screw 7*b* and has the developer outlet 215*a* with a shutter member at the other end of the upper wall. The developer outlet 215*a* is connected to the developer outlet 3. The developer outlet 3 is on one side communicated with the window portion 2*b* that is provided in the excess developer feeding pipe 2. The developer outlet 215*a* is substantially level with the top of the second developer circulator screw 7*b* and is opened upward. Therefore, an increase in amount of the dual-component developer in the developing units 215 does not cause the developer surface level to rise above the second developer circulator screw 7*b*.

The dual-component developer is supplied to the developing units 215 through the developer replenishing ports of the developer cartridges 6 by the turning force and self-weight of a replenishing screw (not shown) for replenishment to compensate the developing units for toner consumed by image formation. The mixing ratio by weight of toner and carriers in this replenishing developer is about 9:1, but is not limited thereto. Considering the volume ratio, it can be rephrased as a minute amount of carriers being mixed in toner since the toner takes up an exceedingly large proportion of the dual-component developer in the developing units 215. In short, a minute amount of carriers are gradually supplied for replenishment when a developing unit is compensated for toner consumed by image formation. As the proportion of carriers in the replenishing developer is increased, if the same amount of toner is supplied for replenishment, more carriers are replaced with new carriers to bring the dual-component developer in the developing units 215 nearer to a fresh state. However, this consumes more carriers and results in an increase in running cost. It is therefore preferable to set a mixture ratio suitable to individual cases. The developer replenishment amount is in most part determined by the rotation number of the replenishing screw, and the rotation number is in turn determined by toner replenishment amount controlling means (not shown).

As has been described, the rotary developing member 201 and the feeding member 1 of the excess developer feeding portion rotates as one in this embodiment. This can simplify discharge control and advances the high image quality stability even further. The need to replace old developer with new developer is thus eliminated, thereby improving the maintenance performance and reducing the running cost.

In addition, the structure of this embodiment is advantageous in terms of feeding ability since the rotation operation of the feeding member 1 is in sync with rotation of the rotary developing member 201. The structure therefore has excellent discharge characteristic and is very effective in attaining stable discharge and high image quality stability.

Moreover, no complicate structural member is necessary to drive the discharging mechanism. This provides an inexpensive external body driving mechanism with a simpler structure as well as an inexpensive internal mechanism of the rotary developing member with a simpler structure. Accordingly, the rotary developing member 201 and, ultimately, the multicolor image forming apparatus 200 are reduced greatly in cost.

It is needless to mention that the present invention is not limited to the structure used in this embodiment for multicolor image forming apparatus, but is applicable to various multicolor image forming apparatus.

As explained above, a simply-structured multicolor image forming apparatus of rotary developing process which has such high maintenance performance as to need no developer exchange and which has high image productivity in successive monochromatic image formation is realized in multicolor image forming apparatus of an embodiment of the present invention.

Two major causes of degradation of developer that is long in use are "toner-spent" which refers to toner fixed to a carrier surface and "extraneous additive adhesion" in which an extraneous additive separated from toner adheres to a carrier surface. When toner-spent or extraneous additive adhesion takes place on a carrier surface, the carrier surface area capable of charging toner is reduced and the toner charge amount is lowered. As a result, the image density is raised, smearing of a white portion with toner or other image defects take place, and scattered toner stains the image forming apparatus.

With the structure of multicolor image forming apparatus of the present invention, as described above, developer containing degraded carriers is discharged from a developing unit to gradually replace old developer with developer containing new carriers. In this way, the progression of carrier degradation is seemingly stopped and characteristics of developer as a whole are stabilized to enhance the high image quality stability.

Furthermore, the present invention is structured such that one end portion of feeding means is engaged with and fixed to engagement means provided in a rotary developing member whereas a cylindrical shaft at the center of the rotary developing member is engaged to the outside of the rotary developing member. Therefore, even in a rotary developing member with collecting and feeding means in which an excess developer collecting inlet of the cylindrical shaft is placed on a cylinder surface of the cylindrical shaft, or in multicolor image forming apparatus that has such rotary developing member as described in detail in the examples of the conventional art, the cylindrical shaft is prevented from being rotated by the rotational motion of the rotary developing member and the feeding means alone is rotated to feed excess developer. A satisfactory feeding ability is thus obtained, making the feeding methods that utilize the rotational motion of a rotary developing member practical enough to be employed in real products.

With the simple structure which does not cause an increase in size or cost of multicolor image forming apparatus and which can avoid an increase in number of parts and resultant increase in cost, the present invention provides a simply-structured multicolor image forming apparatus of rotary developing process which has such high maintenance performance as to need no developer exchange and which has high image productivity.

As described in detail in the above, excess developer containing degraded carriers is discharged from a developing unit to gradually replace old developer with developer containing new carriers. In this way, the progression of carrier degradation is seemingly stopped and characteristics of developer as a whole are stabilized to improve the maintenance performance and the image quality stability.

In addition, excess developer is fed by rotation of feeding means while preventing a containing portion from being rotated by the rotational movement of a rotary member. Therefore, satisfactory feeding ability is obtained and it is made possible to put into practical use the excess developer feeding methods that utilize the rotational motion of a rotary member.

In conclusion, this embodiment can achieve improvement of the maintenance performance and the image quality stability without complicating the structure or increasing the size or cost (for example, an increase in cost due to an increase in number of parts) of image forming apparatus.

What is claimed is:

1. A developing device comprising:

a plurality of developer bearing members each of which bears thereon a developer containing toner and carriers, and which develops an electrostatic image on an image bearing member at a developing position;

a plurality of developer containers, which contain developers, to be supplied to said plurality of developer bearing members, respectively;

a rotary member, which holds, said plurality of developer bearing members and said plurality of developer containers, and which moves selectively one of said plurality of developer bearing members toward said developing position;

a feeding pipe, which is substantially non-rotatably provided, and which receives and feeds excess developer discharged from said plurality of developer containers in association with a replenishment of the developer; and a feeding member, which is provided in said feeding pipe, and which feeds the excess developer in said feeding pipe being moved by receiving a rotating force of said rotary member.

2. A developing device according to claim 1, wherein said feeding member is rotatable integrally with said rotary member.

3. A developing device according to claim 1, wherein said feeding pipe is placed substantially at a center of rotation of said rotary member and includes a single inlet for receiving the excess developer from said plurality of developer containers.

4. A developing device according to claim 3, further comprising a plurality of connection pipes for communication between said single inlet and an excess developer outlet that is provided in each of said plurality of developer containers.

* * * * *